United States Patent [19]

Binder et al.

[11] Patent Number: 4,524,241

[45] Date of Patent: Jun. 18, 1985

[54] INSULATED MULTIWIRE ELECTRIC CABLE HAVING PROTECTED SOLDERABLE AND NON-HEAT-SEALING CONDUCTORS

[75] Inventors: Germaine Binder; Bernard Kremer, both of Paris, France

[73] Assignee: Thomson-Brandt, France

[21] Appl. No.: 440,524

[22] Filed: Nov. 10, 1982

Related U.S. Application Data

[63] Continuation of Ser. No. 213,074, Dec. 4, 1980, abandoned.

[30] Foreign Application Priority Data

Dec. 18, 1979 [FR] France ..... 79 30938

[51] Int. Cl.[3] ..... H01B 1/02; H01B 7/28

[52] U.S. Cl. ..... 174/119 R; 174/126 CP; 420/566; 420/570; 428/643; 428/645

[58] Field of Search ..... 174/126 CP, 119 R, 119 C; 75/166 D; 428/643, 644, 645; 420/566, 570

[56] References Cited

U.S. PATENT DOCUMENTS

| | | | |
|---|---|---|---|
| Re. 30,348 | 9/1980 | Hascoe | 428/643 X |
| 2,056,017 | 9/1936 | Piercy | 174/103 |
| 2,515,022 | 7/1950 | Snyder | 427/431 |
| 2,718,494 | 9/1955 | Faust | 428/645 |
| 2,734,025 | 2/1956 | Roehl | 75/166 D |
| 3,103,067 | 9/1963 | Dixon | 75/166 D |
| 3,692,924 | 9/1972 | Nye | 174/126 CP X |
| 3,753,278 | 9/1973 | Hamaguchi et al. | 428/643 |
| 4,081,602 | 3/1978 | Paniri et al. | 174/103 |

FOREIGN PATENT DOCUMENTS

| | | | |
|---|---|---|---|
| 813622 | 9/1951 | Fed. Rep. of Germany . | |
| 1910629 | 10/1969 | Fed. Rep. of Germany | 174/126 CP |
| 886010 | 10/1943 | France . | |
| 2006737 | 1/1970 | France . | |

OTHER PUBLICATIONS

Manko; H. H., Solders and Soldering, McGraw-Hill Book Co., pp. 106 and 108.

Metals Handbook, Ninth Edition, vol. 2, American Society for Metals, p. 505.

*Primary Examiner*—A. T. Grimley

*Assistant Examiner*—Morris H. Nimmo

*Attorney, Agent, or Firm*—Cushman, Darby & Cushman

[57] ABSTRACT

Insulated multiwire electric cable formed of solderable electric conductors protected by a lead alloy, remaining individually separate even after an operation for the electric insulation of their ply with electric conductors individually coated with a layer of an alloy which comprises for 100% by weight of alloy, a lead content greater than 90% by weight.

4 Claims, 1 Drawing Figure

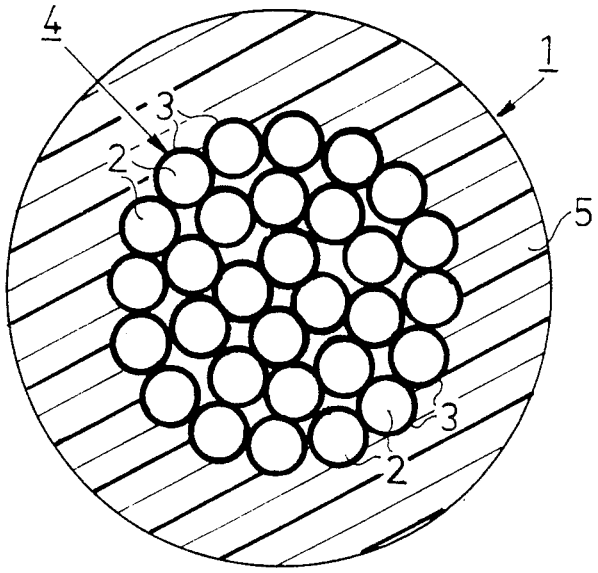
4
1
3
2
5
3
2

INSULATED MULTIWIRE ELECTRIC CABLE HAVING PROTECTED SOLDERABLE AND NON-HEAT-SEALING CONDUCTORS

This is a continuation of application Ser. No. 213,074, filed Dec. 4, 1980 abandoned.

BACKGROUND OF THE INVENTION

The present invention relates to an insulated multiwire electric cable having protected, solderable and non-heat-sealing conductors.

Some cables for aeronautics for example are formed of plies of electric conductors protected by a metal cover and insulated, either by a thermoplastic polymer sheath, or by polyimide tape which may be covered with a sheath of thermoplastic polymer.

The protected electric conductors of known cables are copper wires traditionally coated either with tin, or with silver, or with nickel.

For severe environmental conditions, copper conductors protected by a silver coating are preferably used for the following reasons:

Copper wires protected with tin are not suitable for insulation of the ply by means of a taped coating or a polymer sheath since temperatures of the order of 300°-350° C. causes heat-sealing between the strands of the ply.

This heat-sealing is due to the fact that the melting point of tin is 232° C.

This heat-sealing leads to disadvantages for the cables obtained are not very pliable and, because of the migration of the tin, some zones of the surface of copper conductors are no longer protected by the tin, which leads to deficiencies in solderability and possibilities of corrosion.

Wires protected with nickel have the disadvantage of not being solderable and force the user to carry out crimping or chemical cleaning operations of the nickel for forming connections.

Wires protected with silver are very suitable but they have the disadvantage of being expensive on the one hand and, on the other hand, the protection against electrochemical corrosion of the copper is not ensured since silver does not provide cathodic protection.

It has been thought that lead protections, a metal whose melting point is 321° C., would seem to be suitable for the cable having solderable and non-heat-sealing conductors, but it has proved that lead has insufficient solderability or brazability when used with a 60/40 tin lead filler alloy and that lead does not wet the copper very well, which does not allow electric wires to be obtained which are correctly protected with lead from the point of view of surface appearance and uniform lead distribution.

Lead alloys such as the one with 30% tin and 70% lead have the disadvantage of being no longer solderable after accelerated aging treatments for 96 hours in air and at a temperature of 155° C. or for 4 hours at 100° C. in steam, in accordance with the tests described in the French standard NFC 20 630 paragraph 2.5.

The loss of solderability is due particularly to copper diffusion in the alloy layer which leads to the formation of a type $Cu_3Sn$ nonsolderable intermetal compound.

Alloys of the lead-silver type have the disadvantage of being sensitive to atmospheric humidity during prolonged storage, which causes a complete loss of solderability.

The result is that it is difficult to have in an alloy both good in solderability after aging for 96 hours at 155° C. in air or for 4 hours at 100° C. in steam, and good wetability by molten alloy for electric conductors.

And yet, for cables having solderable and non-heat-sealing conductors, it is necessary for the solderability to be good after accelerated aging, for its offers a facility of effecting soldering and brazing rapidly even if the storage time of the cables has been more or less long.

It is also necessary for the wetability at a temperature of the order of 35° C. of the alloy to be excellent, if not the metal coatings are offset and the soldering or brazing is defective, the coating of the electric conductor with the alloy being carried out by the hot dip process at a temperature of the order of 350° C.

SUMMARY OF THE INVENTION

The present invention, with the aim of avoiding the above-cited disadvantages, allows an economical multiwire cable to be formed having non-heat-sealing electric conductors remaining individually separate even after an operation for the electric insulation of their ply and having good cathodic protection, and good solderability even after accelerated aging such as one of the agings described in the French standard NFC 20.630.

According to the invention an insulated multiwire electric cable whose conductors are non-heat-sealing during an operation for the electric insulation of their ply, and solderable even after accelerated aging, comprises electric conductors individually coated with a layer of a lead alloy which, having good wetability and excellent solderability, comprises for 100% of alloy, with a lead content greater than 90%. The percentages given of the metal constituents of the alloys described and claimed within the scope of the invention are percentages by weight.

In the electric cable constructed in accordance with the invention, no intermetal layer is formed between the conductor and the alloy after accelerated agings of this conductor.

Furthermore, the good wetability characteristics of the alloy coating the conductors of the cable of the invention allow the hot dip process to be advantageously used for coating these conductors.

This advantage is important for if these conductors are protected by silver or nickel, these metals can only be deposited by electrolysis, these protection coats obtained are porous and conserve a part of the chemical compounds of the electrolysis bath.

The presence of these chemical compounds as well as the porosity of the protection coating affect adversely the good solderability after accelerated aging. They promote chemical corrosion.

The hot dip process allows strongly adhesive coatings to be obtained which guarantee a good soldered or brazed joint even in the case of automatic soldering.

This process also allows nonporous, very compact coatings to be obtained which provide good protection against oxidization in the case of prolonged storage as well as good solderability after accelerated aging.

Such coatings formed in accordance with the invention ensure good protection of the conductors of the cable against corrosion even in the case where a lead-silver alloy is used. This seems surprising for lead-silver alloys mentioned in a preceding paragraph are reputed to be sensitive to humidity.

The coating of the conductors of the cable formed in accordance with the invention also avoids these conductors from being sealed together during the operation for insulating the ply thereof for example, by extrusion of a thermoplastic or thermosetting sheath or else for sealing the taping, such operations taking place at temperatures of 300°–350° C. This seems surprising since it was supposed that such coatings should have a melting point higher than 400° C. to avoid any melting or softening which might cause the conductors of the ply to stick together, which explains why silver and to a lesser degree nickel are generally used as metals for protecting these conductors.

In accordance with the invention the thickness of the coating of these conductors is between one and ten microns and preferably between one and five microns.

Greater coating thicknesses cause, during formation of the conductors into a ply, difficulties due to the powdering left by these coatings on the guides and pulleys.

In accordance with the invention, an alloy for coating the conductors of the cable is chosen from alloys having the following compositions:

- lead-silver alloys where for 100% of alloy the lead content varies from 90 to 99% and the silver content varies from 10 to 1%;
- lead-tin alloys where for 100% of alloy the lead content varies from 90 to 99% and the tin content varies from 10 to 1%;
- lead-tin-silver alloys where for 100% of alloy the lead content varies from 90 to 99% and the tin content may vary from 1 to 10%, the complement to 100% being formed by silver.

The process for coating the copper wire is, in accordance with the invention, the process of dipping in a bath of molten alloy.

BRIEF DESCRIPTION OF THE DRAWING

The FIGURE shows an embodiment of the invention.

DESCRIPTION OF THE PREFERRED EMBODIMENTS

Referring to the FIGURE multi-wire cable 1 is formed of a plurality of conductors 2 each coated with a layer 3 of a lead alloy. Electric insulation 5 has been conventionally provided about the conductors.

For a better understanding of the invention a certain number of examples of embodiment are given below.

EXAMPLE I

An annealed copper wire having a diameter of 0.20 mm is first of all cleaned by passing over felt pads imbibed with trichloroethane III, a volatile solvent, having a boiling point of 74° C.

The dry wire then passes over felt pads imbibed with a mordanting-cleaning liquid formed of a solution of 1 N hydrochloric acid, i.e. a molecule gram of acid per liter. The wire then passes into a bath at 350° C. of a molten alloy of lead-silver Pb Ag 3, with 97.5% lead and 2.5% silver for 100% of alloy.

A diamond die, used for drawing copper wires, is placed just at the outlet of the bath; it allows the alloy deposit to be calibrated so as to obtain a thickness of 3 microns. The internal diameter of the die is 0.2080 mm.

The drop solderability of the wire thus protected, measured in accordance with French standard NFC 20 630 paragraph 2.8, is 0.3 second at 235° C. The solderability in the alloy bath of the protected wire, in accordance with paragraph 2.6 of French standard NFC 20 630, is good at 235° C. The drop solderability of the protected wire, measured after accelerated aging for 16 hours at 155° C. in accordance with paragraph 2.53 of French standard NFC 20 630, is 1 second at 235° C.

In a construction of a cable of the invention, 19 protected wires of this type were assembled to obtain a ply of 19×0.20 mm.

The ply obtained is insulated by double crossed taping with a polyimide tape coated with fluoroethylene-propylene for example sold under the trademark KAPTON SG 15 in a width of ¼ inch or 6.35 mm, by the firm DUPONT de NEMOURS.

The overlapping of the tapes is 51%.

The taped ply is finally brought for sealing into stove whose temperature is adjusted to 320° C.–330° C. so as to obtain the cable of the invention.

In a checking operation it was found that the stripped ply of the cable formed is very solderable at 235° C. with a 60/40 Sn Pb filler alloy and that the 19 strands forming the ply do not stick to each other.

EXAMPLE II

Under similar conditions to Example I, a copper wire protected by a Pb Sn Ag 2 alloy having 97% lead, 1% tin and 2% silver for 100% of alloy was formed.

The thickness of the alloy layer coating this wire is 5 microns. The temperature of the molten alloy bath for dip coating this wire is 350° C. The diameter of the die used for calibrating the coating is 0.2120 mm.

The drop solderability of the wire thus protected, measured in accordance with French standard NFC 20 630 paragraph 2.8, is 0.2 seconds at 235° C. The solderability in the alloy bath of the protected wire, in accordance with French standard NFC 20 630 paragraph 2.8 is good at 235° C. The solderability in the alloy bath of the protected wire after accelerated aging for 4 hours in boiling water, in accordance with paragraph 2.51 of French standard NFC 20 630, is good at 235° C.

In a construction of a cable of the invention, a ply of 19×0.20 mm was obtained with protected wires of this type.

This ply is double-taped with a tape of the same type as that of Example I.

Sealing of the tapes of the ply obtained was achieved by passage through an oven whose temperature is 320° C.–330° C.

The taped and sealed ply then passes ten successive times in a bath of polyimide varnish sold for example under the trademark Liquid H by the firm DUPONT de NEMOURS.

After each coating by passing through the bath of varnish, this ply passes into an oven at a temperature of 400° C.

The technique used for this coating is that which is currently employed for the manufacture of enamelled wires.

The extra insulation thickness coming from the varnish after drying and baking is 80 microns on the diameter.

During an operation for checking the cable thus obtained it was noticed that the strands of the ply of the cable were not sticking together and that the stripped part of the ply was solderable at 235° C. with a 60/40 Sn Ph filler alloy.

EXAMPLE III

Under conditions similar to those of Example I a copper wire was formed protected by a Pb Sn 8 alloy formed from 92% lead, 8% tin, for 100% of alloy.

The thickness of the alloy layer coating this wire is 1 micron. The die used for calibrating this coating has a diameter of 0.2032 mm. The temperature of the molten alloy bath for dip coating this wire is 350° C.

The drop solderability of the wire thus protected, measured in accordance with French standard NFC 20 630, is 0.3 second at 235° C. The solderability in the alloy bath of this protected wire is good and the drop solderablity of this latter after aging for 4 hours in boiling water is 1 second at 235° C.

In a construction of a cable of the invention, 19 protected wires of this type were assembled to obtain a ply of 19×0.20 mm.

The ply then passes into an extruder supplied with tetrafluoroethylene ethylene sold for example under the trademark TEFZEL 200 by the firm DUPONT de NEMOURS, at a temperature of the order of 330° C.

The thickness of the coating deposited was 0.2 mm.

During the operation for checking the cable thus obtained, it was noticed that the strands of the ply were not sticking together and that the solderability of the ply took place at 235° C. with a 60/40 tin-lead filler alloy in less than 1 second.

EXAMPLE IV

Under conditions similar to those of Example I, a wire was prepared protected by a Pb Ag 5 alloy, whose lead content is 94.5% and silver content 5.5% for 100% alloy.

The thickness of the deposited coating layer is 5 microns. The die used for calibrating this coating is 0.2120 mm. The temperature of the bath of molten alloy for dip coating this wire is 350° C.

The drop solderability of the wire thus protected, measured in accordance with French standard NFC 20 630 is 0.2 second at 235° C. The solderability in the alloy bath of this protected wire is good at 235° C. The solderability of this latter after aging for 16 hours at 155° C. is also good.

In a construction of a cable of the invention, 19 protected wires of this type were assembled to obtain a ply of 19×0.20 mm.

This ply was covered with double-taping like that described in Example I.

The ply sealed in the oven at 320° C.–330° C. then passes into a bath containing a solution of propylene fluoroethylene sold for example under the trademark TEFLON 120 by the firm DUPONT de NEMOURS.

The coating technique is the same as that described in Example II.

Drying and baking also take place at a temperature of 400° C.

The extra thickness deposited of fluoroethylene propylene polymer (FEP) is 90 microns on the diameter.

During an operation for checking the cable thus obtained, it was noticed that the stands of the ply of the cable were not sticking together and that the solderability of the ply took place at 235° C. with a 60/40 tin lead alloy in less than a second.

What is claimed is:

1. A flexible insulated multiwire electric cable comprising plural uninsulated conductors surrounded by a sheath layer of electrical insulation material, each said uninsulated conductor protected by a layer of lead alloy, non-heat-sealing during formation of the sheath layer at temperatures of 300°–350° C. yet solderable even after accelerated aging, wherein each of said plural uninsulated electric conductors is individually coated with a said layer of lead alloy which has good wetability and excellent solderability and which does not lead to the formation of a nonsolderable brittle intermetallic compound, said layer being constituted by 100% alloy, said alloy consisting essentially of lead within the range 90% to 99% and tin within the range of 10% to 1%.

2. A flexible insulated multiwire electric cable comprising plural uninsulated conductors surrounded by a sheath layer of electrical insulation material, each said uninsulated conductor protected by a layer of lead alloy, non-heat-sealing during formation of the sheath layer at temperatures of 300°–350° C. yet solderable even after accelerated aging, wherein each of said plural uninsulated electric conductors is individually coated with a said layer of lead alloy which has good wetability and excellent solderability and which does not lead to the formation of a nonsolderable brittle intermetallic compound, said layer being constituted by 100% alloy, said alloy consisting essentially of lead within the range 90% to 99% and silver within the range 10% to 1%.

3. A flexible insulated multiwire electric cable comprising plural uninsulated conductors surrounded by a sheath layer of electrical insulation material, each said uninsulated conductor protected by a layer of lead alloy, non-heat-sealing during formation of the sheath layer at temperatures 300°–350° C. yet solderable even after accelerated aging, wherein each of said plural uninsulated electric conductors is individually coated with a said layer of lead alloy which has good wetability and excellent solderability and which does not lead to the formation of a nonsolderable brittle intermetallic compound, said layer being constituted by 100% alloy, said alloy consisting essentially of lead within the range 90% to 99%, tin within the range 10% to 1% and silver forming the complement.

4. The cable as claimed in claim 1, 2 or 3 in which said uninsulated electric conductors are individually coated with said layer of lead alloy having a thickness ranging from one to ten microns according to the dipping process.

* * * * *